United States Patent [19]

Schwab et al.

[11] Patent Number: 4,557,734

[45] Date of Patent: Dec. 10, 1985

[54] MICROEMULSIONS FROM VEGETABLE OIL AND LOWER ALCOHOL WITH OCTANOL SURFACTANT AS ALTERNATIVE FUEL FOR DIESEL ENGINES

[75] Inventors: Arthur W. Schwab; Everett H. Pryde, both of Peoria, Ill.

[73] Assignee: The United States of America as represented by the Secretary of Agriculture, Washington, D.C.

[21] Appl. No.: 638,826

[22] Filed: Aug. 8, 1984

[51] Int. Cl.[4] ..... C10L 1/18

[52] U.S. Cl. ..... 44/53; 44/57; 44/66; 252/356; 252/357

[58] Field of Search ..... 44/53, 66, 57; 252/356, 252/357

[56] References Cited

PUBLICATIONS

C. E. Goering, "Effect of Nonpetroleum Fuels on Durability of Direct-Injection Diesel Engines", Jan. 5, 1984.

C. E. Goering et al., "Evaluation of Soybean Oil-Aqueous Ethanol Microemulsions for Diesel Engines", Apr. 1982.

*Primary Examiner*—Y. Harris-Smith

*Attorney, Agent, or Firm*—M. Howard Silverstein; David G. McConnell; Curtis P. Ribando

[57] ABSTRACT

Hybrid fuel microemulsions are prepared from vegetable oil, methanol or ethanol, a straight-chain isomer of octanol, and optionally water. The fuels are characterized by a relatively high water tolerance, acceptable viscosity, and performance properties comparable to No. 2 diesel fuel.

9 Claims, 4 Drawing Figures

MICROEMULSIONS FROM VEGETABLE OIL AND LOWER ALCOHOL WITH OCTANOL SURFACTANT AS ALTERNATIVE FUEL FOR DIESEL ENGINES

BACKGROUND OF THE INVENTION

1. Field of the Invention

The energy crisis of recent years has stimulated research in the field of alternate and hybrid fuels. One area of particular interest relates to fuels for commercial and agricultural vehicles that are powered by diesel engines. The prospect of farmers becoming self-sufficient in regard to their energy needs has led to investigations of vegetable oils as diesel fuel substitutes. Deterrents to this concept are the generally inferior fuel properties of crude vegetable oils as compared to those of diesel oil. Of particular concern is the inherently high viscosity which causes poor atomization in direct-injected diesel engines. This results in fouling of the injectors and cylinders as well as a buildup of noncombusted fuel in the crankcase causing a thickening of the lubricating oil. This invention relates to a blended vegetable oil fuel which circumvents many of these problems.

2. Description of the Prior Art

One approach to the utilization of vegetable oil as fuel has been to mix it with conventional diesel oil. Insofar as these blends must contain at least two-thirds diesel fuel in order to have acceptable properties, they fall short of meeting the farmer's goal of energy self-sufficiency. Cracking and refining are effective in upgrading vegetable oils, but add considerably to the expense and also negative direct on-the-farm utilization of the harvested product. Likewise, transesterification with a lower alcohol yields a fuel with lower viscosity and acceptable performance properties, but reduces the feasibility of direct use. Moreover, the esters have a solidification temperature of about 4° C., requiring the use of fuel preheaters in colder climates.

The concept of diluting the vegetable oil with lower alcohols, particularly ethanol, is confronted with many of the same difficulties characteristic of diesel fuel-ethanol hybrids. As pointed out by Wrage et al. [Technical Feasibility of Diesohol, ASAE Paper No. 79-1052 (1979)], the most critical problem is phase separation initiated by the presence of trace amounts of water. The water tolerance of blends decreases with decreasing temperature. At 0° C., a water concentration of only 0.05% will cause phase separation. Since this amount can readily be absorbed in the fuel during transport and storage, anhydrous ethanol-oil blends tend to be impractical.

Accordingly, a preponderance of the research efforts on hybrid fuels has been aimed at increasing the water tolerance to not only allow for water absorption, but also to permit the use of aqueous alcohol. It has been reported that when water is properly incorporated into a diesel fuel, it serves as a heat sink, thereby lowering combustion temperatures and reducing $NO_x$ and smoke emissions [G. Gillberg et al., Microemulsions as Diesel Fuels, pp. 221–231 in J. T. Zung (ed.), Evaporation-Combustion of Fuels. Advances in Chemistry Series No. 166, ACS]. This phenomenon is also discussed by N. R. Iammartino [Chem. Eng. 24: 84–88 (Nov. 11, 1974)], D. W. Brownawell et al., U.S. Pat. No. 3,527,581, and E. C. Wenzel et al., U.S. Pat. No. 4,038,698.

The intimate admixture of water and oil in the presence of one or more surfactants results in either a macroemulsion or a microemulsion. Macroemulsions have dispersed particles with diameters in the 200 to 10,000 nm. range and are not stable, eventually separating into two phases. Microemulsions are transparent, optically isotropic, thermodynamically stable colloidal dispersions in which the diameter of the dispersed-phase particles is less than one-fourth the wavelength of visible light. Considerably more surfactant is required to create a microemulsion than a macroemulsion since the volume of the interphase of a microemulsion is an appreciable percentage of the total volume of the dispersed sphere (the core plus the interphase). Microemulsions are generally accepted as micellar systems and may be classified as detergent or detergentless.

In the commonly assigned U.S. Pat. No. 4,451,265, A. W. Schwab discloses stabilizing a hybrid diesel fuel microemulsion having relatively high levels of water and alcohol by means of a two-component surfactant system. One of the components is N,N-dimethylethanolamine and the other is a long-chain fatty acid substance. Commonly assigned U.S. Pat. No. 4,451,267 shows a hybrid diesel fuel microemulsion in which the surfactant is selected from various trialkylamines aand trialkylamine soaps of fatty acid substances. In application Ser. No. 06/423,402, now U.S. Pat. No. 4,526,586 filed by A. W. Schwab and E. H. Pryde, a nonionic hybrid fuel is formulated from 1-butanol as the surfactant. While these formulations are more water tolerant than many predecessor hybrid fuels, the critical solution temperatures are not low enough to permit full-season use in temperate climates.

SUMMARY OF THE INVENTION

We have now developed a vegetable oil-based hybrid fuel for diesel engines characterized by a critical solution temperature as low as −10° C. in the presence of more than 1% water. The fuel is a detergentless microemulsion in which either an anhydrous or aqueous lower alcohol is dispersed in the oil by means of a straight-chain octanol serving as a single-component nonionic surfactant. Despite the absence of an ionic emulsifier, these microemulsions display all the desirable physical and chemical properties exhibited by those hybrid fuels heretofore formulated with multicomponent detergent systems.

In accordance with this discovery, it is an object of the invention to convert crude vegetable oil into a fuel suitable for diesel engines without alteration of its chemical structure.

It is also an object of the invention to prepare an economically attractive vegetable oil-based fuel which lends itself to on-the-farm blending.

Another object of the invention is to prepare a nonpetroleum alternative diesel fuel which is tolerant to relatively high levels of water even at temperatures below 0° C.

A further object of the invention is to produce a totally nonionic microemulsion fuel free of corrosive emulsifiers.

Other objects and advantages of the invention will become readily apparent from the ensuing description.

DETAILED DESCRIPTION OF THE INVENTION

The base vegetable oils for use in the fuels of the invention are the commonly available vegetable triglycerides in which the preponderance of the fatty acid ester moieties have a chain length of 18 or more carbon atoms. The general suitability of these oils as diesel fuel substitutes has been summarized by C. E. Goering et al. [Trans. ASAE 25(6): 1472–1477, 1483 (1982)]. In terms of high cetane rating, long induction period, low viscosity, low cloud point, and low pour point, the preferred oils are soybean, corn, rapeseed, sesame, and cottonseed. However, others including crambe, sunflower, peanut, linseed, safflower, and high oleic safflower would be operative. While it is contemplated that these oils be employed in the crude state as originally expressed from the seed material, there are advantages to subjecting them to certain preliminary processing steps. For example, winterization to remove the saturated fatty acid triglycerides extends the lower end of the operable temperature range. Alkali refining removes the free fatty acids thereby reducing corrosivity and the tendency to pick up metal ions that promote oxidative instability. Degumming is desirable for reduced tendency to deposit gummy residues, enhanced atomization, and inhibition of injector fouling. Viscosities of the aforementioned oils when degummed and alkali-refined typically range from about 27 centistokes (cSt., $mm.^2/s.$) at 37.8° C. for lineseend oil to about 54 cSt. for crambe oil. Other properties related to the performance of these oils as engine fuels have been summarized by Goering, supra. Synthetic counterparts of the natural oils such as triolein are also considered to be within the scope of the term "vegetable oils" for purposes of the invention.

The lower alcohols contemplated for hybridizing with the vegetable oil include methanol and ethanol. The alcohol may be anhydrous or aqueous. In its aqueous form the alcohol is a convenient source of water, as discussed further below.

Figure 1:
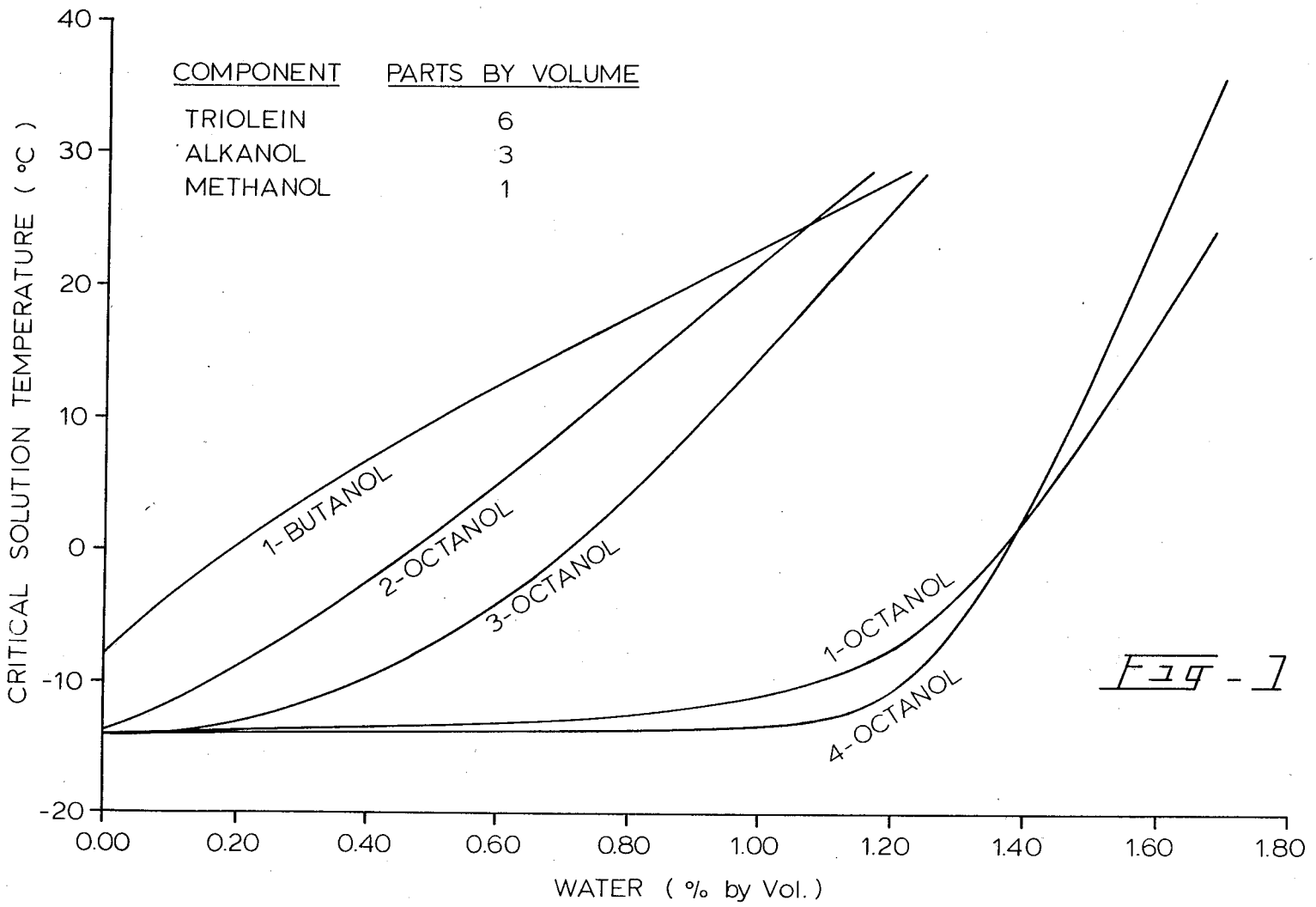
FIG. 1 is a plot of the critical solution temperatures of the four straight-chain octanol isomers as compared to that of 1-butanol.

The surfactant contemplated herein may be any of the straight-chain isomers of octanol to include 1-octanol, 2-octanol, 3-octanol, and 4-octanol. Its function is to convert the mixture of vegetable oil, lower alcohol, and any water, either associated with the alcohol or otherwise introduced into the fuel formulation, to a microemulsion without the need for an ionic detergent. The relative proportions of these components, as well as the particular selection of vegetable oil and octanol isomer, will determine the properties of the final fuel composition. In formulating the hybrid fuels of the invention, primary consideration is given to microemulsion stability and viscosity. Acceptable viscosities would typically be in the range of about 2–9 cSt. at 37.8° C. The microemulsion stability is a function of the water tolerance. FIG. 1 shows that for a typical formulation consisting essentially of 60% oil (triolein), 30% octanol, and 10% methanol, all four of the octanol isomers have a higher water tolerance than butanol. While 1-octanol and 4-octanol are the best in terms of critical solution temperature, 2-octanol is currently preferred in terms of availability and economics. 2-Octanol has a cetane number of approximately 30. Other pertinent properties to consider in formulating the instant fuels relate to engine performance, including cetane number, power output, brake thermal efficiency, BMEP, and the like.

In regard to the proportion of the oil in the hybrid fuel formulations, the upper limit will be set by the maximum tolerable viscosity (about 9 cSt. at 37.8° C.), and the lower limit by engine performance as determined by the person of ordinary skill in the art. For most of the aforementioned vegetable oils, the level of addition will typically be within the range of about 40–70% by volume. The remainder of the composition comprises the lower alcohol, the octanol, and water in any combination yielding a microemulsion which is stable at or above a predetermined temperature and which is characterized by an acceptable viscosity. If water is intentionally added for the purpose of enhancing the fuel's combustion properties, it should be incorporated in an amount of at least about 0.1%. This level can be achieved by direct addition or by means of the addition of 2% of 95% aqueous alcohol or 0.5% of 80% aqueous alcohol. Within the confines of these parameters, the properties of the hybrid fuels can be tailored to satisfy a multitude of conditions. For example, as the proportion of vegetable oil to water and/or lower alcohol is increased, the cetane number increases. As the relative amount of water to lower alcohol decreases, particularly at the higher ratios of vegetable oil to lower alcohol, or as the octanol level increases, the viscosity decreases. Also, reduction of the water:lower alcohol ratio enhances the tolerance of the system to phase separation, thereby either permitting the use of less surfactant, or allowing the ratio of lower alcohol to vegetable oil to be increased.

Figure 2:
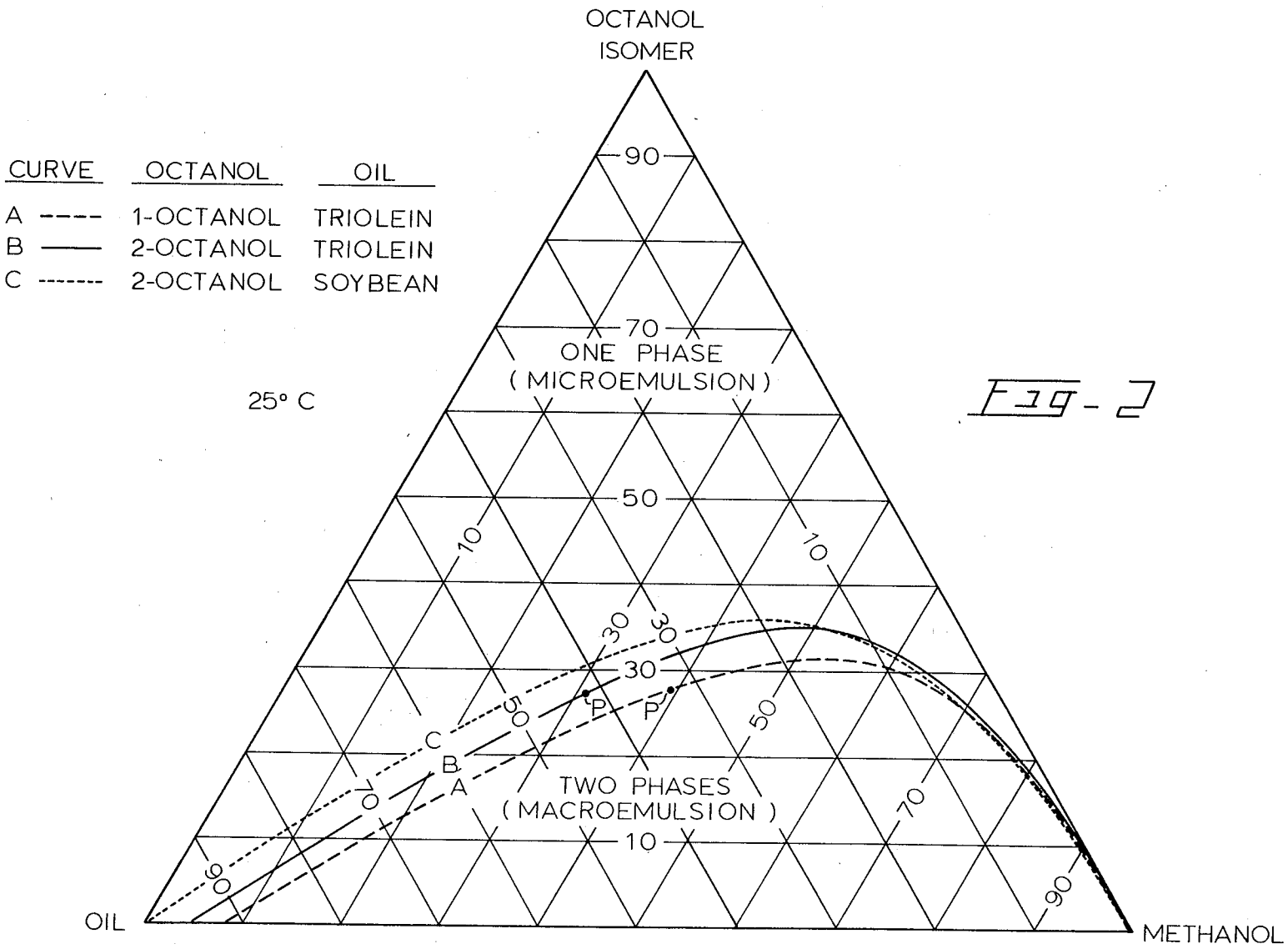
FIG. 2 depicts a ternary phase diagram for 100% methanol in combination with each of 1-octanol and triolein, 2-octanol and triolein, and 2-octanol and soybean oil.
Figure 3:
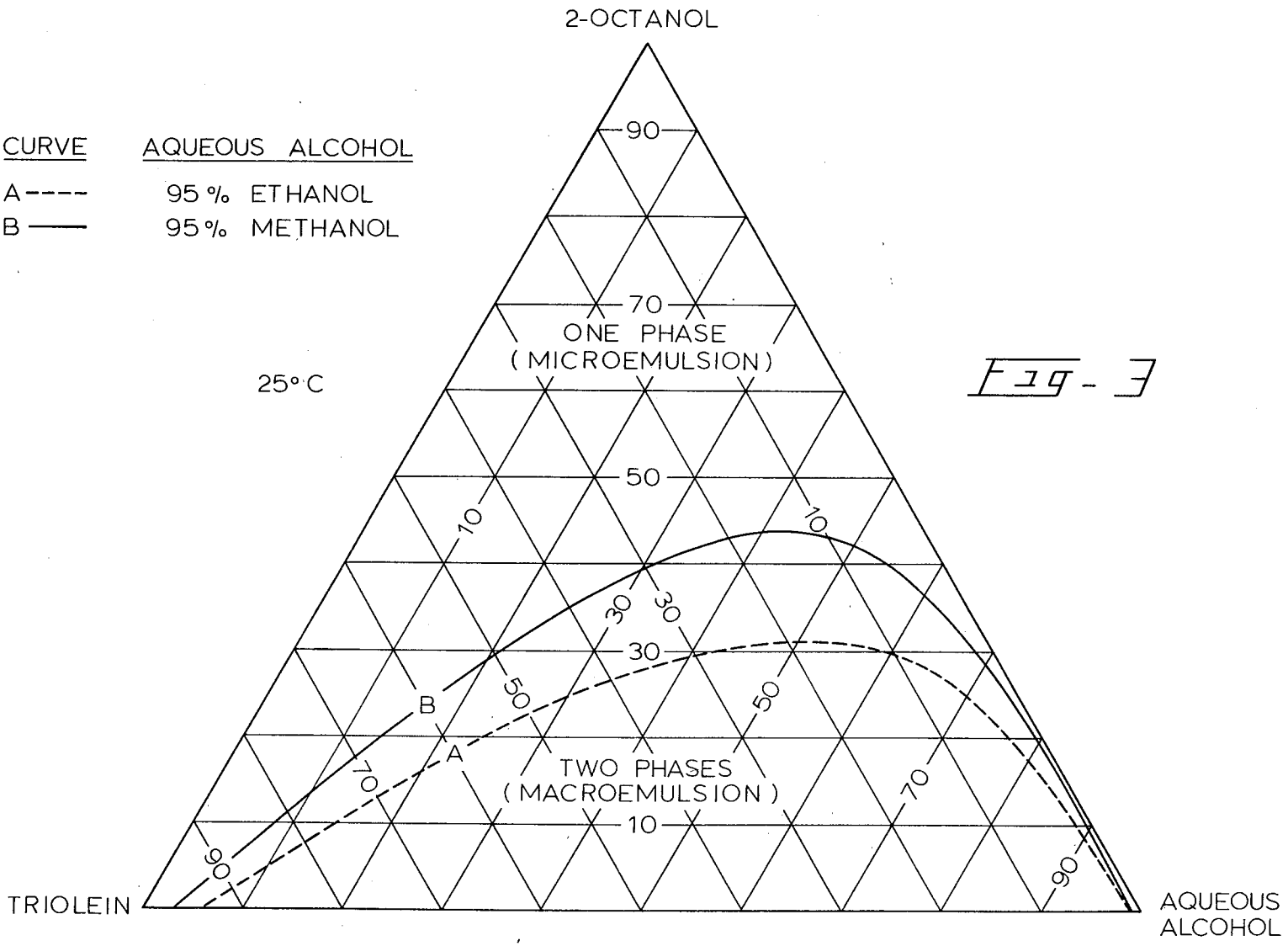
FIG. 3 depicts a ternary phase diagram for 2-octanol and triolein in combination with each of 95% aqueous methanol and 95% aqueous ethanol in a fuel formulation.

The ternary phase diagrams at 25° C. of FIG. 2 illustrate fuels employing two of the octanol surfactants within the scope of the invention. At a given temperature, the formulations above each respective miscibility curve will exist as one visible phase in the form of thermodynamically stable microemulsions, while those below the curves will be unstable and have two visible immiscible phases. The oil in the formulation to the left of the plait point P on each of curves A and B is in the continuous phase, while to the right of P the oil is in the discontinuous phase. The curves in FIG. 2 assume that no water is present. The area above the curve diminishes as water is added as illustrated by a comparison of curve B in FIG. 2 with curve B in FIG. 3. This area also decreases as the temperature decreases. Fuels formulated within the aforementioned parameters must of course also come within the microemulsion region of the appropriate diagram for a predetermined temperature specification to be considered within the scope of the invention. In FIG. 2, the microemulsion region is greatest for the 1-octanol in a trioleinmethanol system. As evidenced by a comparison of triolein and soybean oil formulatedd with 2-octanol, it would be understood that curves generated for the other aforementioned vegetable oils would be of the same general shape but not necessarily coincident with those shown. FIG. 3 shows the effect of substituting 95% ethanol for 95% methanol in a triolein and 2-octanol system at 25° C. Based thereon, it could reasonably be predicted that the ethanol would generally perform better than methanol in terms of microemulsion stability.

The order of adding the fuel constituents to one another is not particularly critical. Though the microemulsions will form spontaneously without mixing, any conventional means of simple agitation such as gentle stirring or shaking will expedite the process.

The actual physical structure of a detergentless microemulsion is unknown. However, in the context of the present system, it can be thought of as the presence of an interphase separating submicroscopic droplets of the lower alcohol and/or water in the discontinuous phase from the vegetable oil in the continuous phase. The presence of a microemulsion is readily ascertained by standard methods of rheology, light scattering, ultracentrifugation, conductivity, refractivity, and density.

The cetane value of the hybrid fuels of the invention varies with the amount of vegetable oil. Typically these fuels will have cetane numbers lower than the minimum ASTM specification of 40 for No. 2 diesel oil without adverse effect on engine performance. This is presumably attributable to the presence of the water. However, it is envisioned that cetane improvers such as primary alkyl nitrates and other fuel additives as known in the art may be included in the instant formualations in minor amounts without significant adverse effect on the microemulsion stability. The critical solution temperatures of the present fuels is also dependent upon the specific formulation, but may be as low or even lower than −14° C.

The following examples are intended only to further illustrate the invention and are not intended to limit the scope of the invention which is defined by the claims.

EXAMPLE 1

Into samples vials were pipetted soybean oil, anhydrous methanol, and 2-octanol in various proportions. The oil was a commercial grade, alkali-refined and bleached soybean oil having an analysis of 55.5% linoleic, 23.2% oleic, 6.3% linolenic, 11.8% palmitic, and 3.2% stearic acids. Upon gently shaking the sample vials, the mixtures immediately formed clear, homogeneous, nonionic microemulsions. Viscosities were determined using a calibrated "Cannon-Fenske" viscometer (size 100) in a "Scientific Development" kinematic viscosity bath at 37.8° C. (100° F.). Tests were conducted by ASTM Standard D 445-74. The results are reported in Table I, below, as the average of triplicate runs. In view of the comparatively high viscosity, formulation IA is considered to be outside the scope of the invention.

EXAMPLE 2

A nonionic hybrid microemulsion fuel was formulated by mixing in a 190-liter drum from the following components:

| | % by volume |
|---|---|
| soybean oil (once refined) | 52.8 |
| methanol (anhydrous) | 13.2 |
| 2-octanol | 33.0 |
| commercial cetane improver | 1.0 |
| | 100.0 |

The fuel was tested in a 4-cylinder "John Deere" model 4219D, 3.589-L turbocharged diesel engine rated at 41.8 kW continuous at 2200 rev./min. and having a compression ratio of 16.3:1.

An AW model 400 portable, cradled dynamometer was used to provide engine loads. Fuel consumption was measured through use of an automated weighing system. Temperatures at critical points including the exhaust gas, coolant, return fuel, lubricating oil in the pan, and air in the intake manifold were monitored with chromel-alumel thermocouples and with a digital indicator.

Commercial grade No. 2 diesel fuel was used as a reference fuel. A comparison of the properties of the diesel fuel and the microemulsion fuel is given in Table II, below.

Following a break-in period, the engine was subjected to an initial performance test with each fuel over a wide range of speeds. Torque, speed, fuel consumption, critical temperatures, atmospheric conditions, and blowby were observed at each engine load. The fuels were thereafter evaluated in accord with the Engine Manufacturer's Association (EMA) test sequence.

TABLE I

| Formulation | Soybean oil (volume %) | Anhydrous methanol (volume %) | 2-Octanol (volume %) | Viscosity at 37.8° C. (cSt.) |
|---|---|---|---|---|
| 1A | 68.4 | 17.1 | 14.5 | 9.44 |
| 1B | 66.6 | 16.7 | 16.7 | 9.00 |
| 1C | 61.5 | 15.4 | 23.1 | 8.28 |
| 1D | 57.1 | 14.3 | 28.6 | 7.81 |
| 1E | 53.4 | 13.3 | 33.3 | 7.54 |

TABLE II

| Property | Fuel: Microemulsion | Fuel: No. 2 diesel | Limits for No. 2 diesel |
|---|---|---|---|
| Viscosity, mm.²/s. | 8.30[a] | 2.82[b] | 1.9–4.1[a] |
| Gross heat of combustion, kJ./kg. | 37788 | 45529 | 45343 |
| Cetane No. | 33.1 | 51.4 | 40 min. |
| Carbon residue, % | 0.42[c] | 0.01[d] | 0.35[d] |
| Flash point, °C. | 12.2 | 62.2 | 51.7 |
| Cloud point, °C. | −11.1 | −15.6 | —[e] |
| Pour point, °C. | −23.3 | −34.3 | —[f] |

[a]Measured at 38° C.
[b]Measured at 40° C.
[c]Percent of whole sample.
[d]On 10% residium.
[e]Cloud point is not specified by ASTM. Satisfactory operation should be achieved in most cases if the cloud point is 6° C. above the tenth percentile minimum temperature for the area where the fuel will be used.
[f]Pour point is not specified by ASTM, but generally occurs at 4.4 to 5.5° C. below the cloud point.

Figure 4:
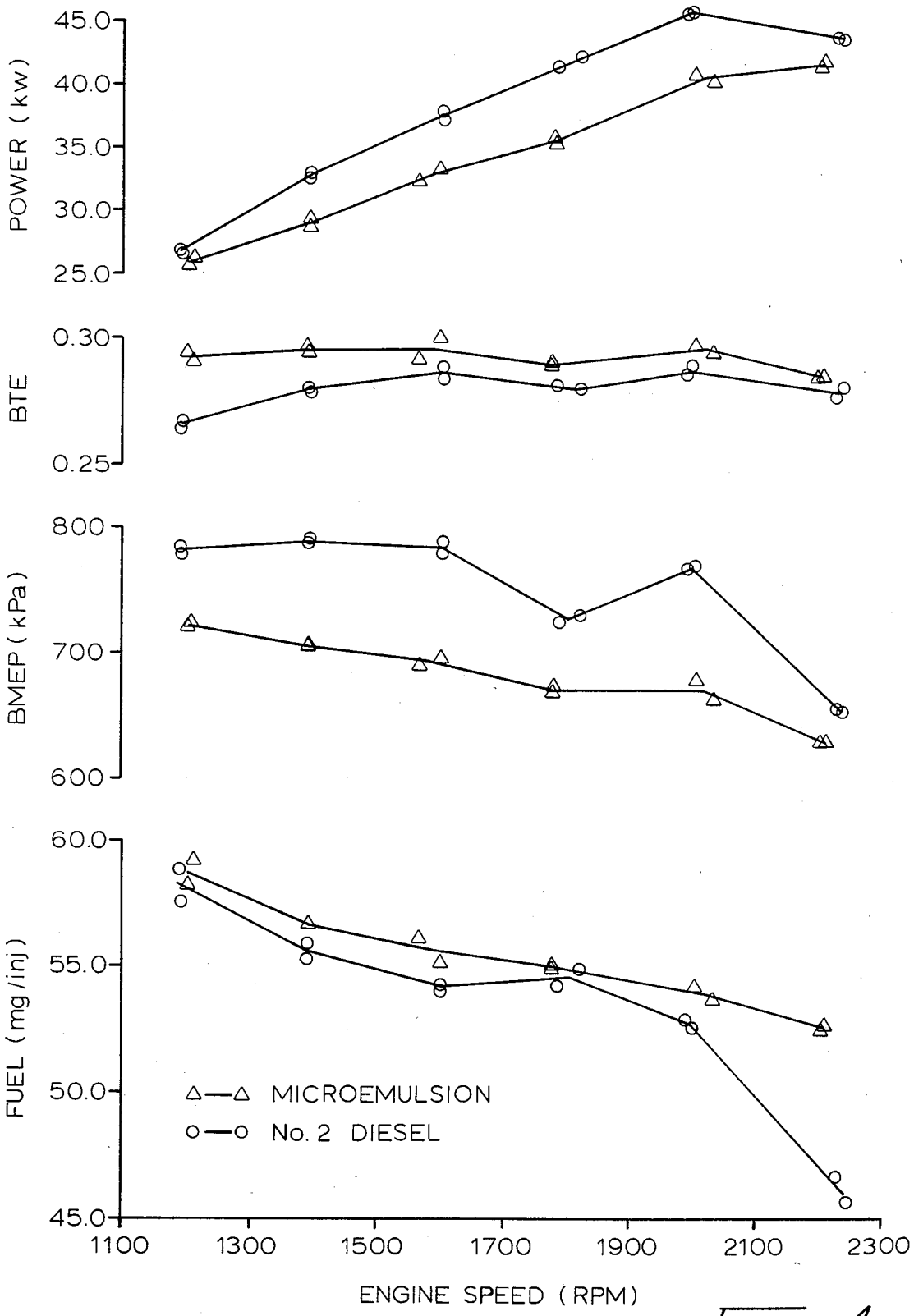
FIG. 4 is a series of engine performance curves comparing a hybrid microemulsion fuel prepared in accordance with the invention to No. 2 diesel fuel.

Oil samples were taken daily during the tests for viscosity measurement and additional samples were taken at 50-hour intervals for wear metal analysis. After 200 EMA hours, the engine was again performance tested and then disassembled and measured. The power, brake thermal efficiency (BTE), brake means effective pressure (BMEP), and rate of fuel consumption through the peak power output for the 200-hour test are illustrated in FIG. 4 as the conglommerate of duplicate runs. The nozzles showed the same average opening pressure and orifice diameters for both the diesel fuel and the microemulsion, though carbon deposits on two of the nozzles used with the microemulsion fuel resulted in mushy injection. Carbon and lacquer deposits on the pistons and carbon deposits on the valves and tops of the cylinder liners were also higher for the microemulsion fuel. The average consumption of lubricating oil during the diesel fuel test was 30.7 ml./hour as opposed to zero for the microemulsion. No significant differences in operating temperature were noted between the two fuels other than the exhaust temperatures were about 90°–100° C. cooler for the microemulsion fuel at engine speeds under about 2050 rev./min. In general, the microemulsion was superior to the No. 2 diesel fuel in terms of engine wear, as reported in Table III.

EXAMPLE 3

As a comparison of the water tolerance of 1-octanol to other 1-alkanols ranging from $C_4$ to $C_{14}$, formulations were prepared by admixing 24 ml. triolein, 12 ml. alkanol, and 40 ml. methanol. After measuring the critical solution temperature, water was added in increments of 1 ml. or less until cloudiness was observed at 25° C. or above. Interpolated water tolerance values normalized to 25° C. are given in Table IV, below.

It is understood that the foregoing detailed description is given merely by way of illustration and that modification and variations may be made therein without departing from the spirit and scope of the invention.

TABLE III

| Component | Average wear (mg. lost) Microemulsion | No. 2 diesel |
|---|---|---|
| Main bearing, block | 8.1 | 31.1 |
| Main bearing, cap | 20.6 | 38.4 |
| Rod bearing, rod | 10.8 | 16.2 |
| Rod bearing, cap | 6.5 | 12.9 |
| Piston ring, No. 1 | 169.3 | 90.0 |
| Piston ring, No. 2 | 36.7 | 41.1 |
| Piston ring, No. 3 | 17.9 | 49.0 |

TABLE IV

| Alkanol | % Water tolerance at 25° C. |
|---|---|
| 1-Butanol | 1.07 |
| 1-Hexanol | 1.48 |
| 1-Octanol | 1.70 |
| 1-Decanol | 1.38 |
| 1-Dodecanol | 1.10 |
| 1-Tetradecanol | 0.90 |

We claim:

1. A hybrid fuel composition comprising:
(a) a vegetable oil;
(b) a lower alcohol selected from methanol and ethanol;
(c) optionally, water; and
(d) a surfactant comprising a straight-chain isomer of octanol;
wherein said octanol surfactant is present in the fuel composition in an amount effective for said composition to exist as a thermodynamically stable microemulsion and the combined amounts of lower alcohol, water, and surfactant relative to said vegetable oil are sufficient to impart to said composition a kinematic viscosity in the range of 2–9 centistokes at 37.8° C.

2. A hybrid fuel composition as described in claim 1 wherein said vegetable oil is selected from the group consisting of soybean, corn, rapeseed, sesame, cottonseed, crambe, sunflower seed, peanut, linseed, safflower, high oleic safflower, and triolein.

3. A hybrid fuel composition as described in claim 1 wherein said vegetable oil is soybean oil.

4. A hybrid fuel composition as described in claim 1 wherein said vegetable oil is sunflower seed oil.

5. A hybrid fuel composition as described in claim 1 wherein said lower alcohol is methanol.

6. A hybrid fuel composition as described in claim 1 wherein said lower alcohol is ethanol.

7. A hybrid fuel composition as described in claim 1 wherein the ratio of lower alcohol:water is about 19:1.

8. A hybrid fuel composition as described in claim 1 wherein said surfactant is 1-octanol.

9. A hybrid fuel composition as described in claim 1 wherein said surfactant is 2-octanol.

* * * * *